US006167723B1

(12) United States Patent
Guillard

(10) Patent No.: US 6,167,723 B1
(45) Date of Patent: Jan. 2, 2001

(54) INSTALLATION FOR THE DISTILLATION OF AIR AND CORRESPONDING COLD BOX

(75) Inventor: Alain Guillard, Paris (FR)

(73) Assignee: L'Air Liquide, Societe Anonyme pour l'Etude et l'Exploitation des Procedes Georges Claude, Paris Cedex (FR)

( * ) Notice: Under 35 U.S.C. 154(b), the term of this patent shall be extended for 0 days.

(21) Appl. No.: 09/302,995

(22) Filed: Apr. 30, 1999

(30) Foreign Application Priority Data

Apr. 30, 1998 (FR) ..... 98 05532

(51) Int. Cl.[7] ..... F25J 1/00

(52) U.S. Cl. ..... 62/646; 62/905; 62/907; 62/654

(58) Field of Search ..... 62/646, 905, 907, 62/654

(56) References Cited

U.S. PATENT DOCUMENTS 5,209,070 * 5/1993 Darredeau ..... 62/646
5,244,489 9/1993 Grenier .
5,412,954 * 5/1995 Grenier ..... 62/907
5,438,835 * 8/1995 Rathbone ..... 62/646
5,442,925 8/1995 Agrawal et al. .
5,461,871 * 10/1995 Bracque et al. ..... 62/905
5,485,729 * 1/1996 Higginbotham ..... 62/646
5,490,391 * 2/1996 Hogg et al. ..... 62/646
5,582,031 * 12/1996 Rathbone ..... 62/646
5,649,433 * 7/1997 Suzuki et al. ..... 62/905

FOREIGN PATENT DOCUMENTS 2 143 986 2/1973 (FR) .

* cited by examiner

*Primary Examiner*—Ronald Capossela
(74) *Attorney, Agent, or Firm*—Young & Thompson

(57) ABSTRACT

In this installation (1) for the distillation of air in a double column, the low pressure column and the medium pressure column are disposed side by side and the base of the low pressure column (3) is above the base of the medium pressure column (2). The low pressure column is disposed above an element for confining a cryogenic fluid which can be a mixing column (5), an argon column, a column operating at a pressure intermediate the medium pressure and the low pressure, a storage (32) or an exchanger.

11 Claims, 2 Drawing Sheets

INSTALLATION FOR THE DISTILLATION OF AIR AND CORRESPONDING COLD BOX

The present invention relates to an installation for the distillation of air of the type comprising a medium pressure column, a low pressure column and a vaporizer-condensor for placing in heat exchange relation a calorigenic gas with a liquid from the low pressure column.

The invention is applicable particularly to supplying impure oxygen, for example for the supply of blast furnaces in ferrous metallurgical industry.

To ensure such a supply of impure oxygen, it is known to use an installation of the type mentioned above which comprises moreover a mixing column. Such a mixing column operates under a pressure substantially equal to or lower than the medium pressure. It is supplied at its base with a gas such as purified and compressed air and at its head with a liquid more volatile than the gas, such as impure liquid oxygen from the base of the low pressure column and brought by pumping to the pressure of the mixing column. There is withdrawn from the head of such a mixing column impure gaseous oxygen to be supplied substantially at the pressure of the mixing column.

Generally, the low pressure column is above the vaporizer-condenser, which itself is above the medium pressure column. The double column thus comprises a single upright structure and the mixing column is disposed beside the double column. This arrangement of the double column permits prefabrication in the plant of the installation in a limited number of cold boxes or packages of which a principal package comprises the double column. These packages are then transported to the work site, where they are erected and connected to form the installation for the distillation of air.

The construction of the vaporizer-condensers is generally carried out by operations separate from those for the construction of the distillation and mixing columns, of the storage reservoirs for cryogenic liquid (of low capacity which can be up to about 10 $m^3$) and more generally of the elements for confining the cryogenic fluid.

Because of this, the pre-assembly of the principal package is subject to delivery of the vaporizer-condenser, which gives rise to delays of prefabrication of the principal package and hence of the relatively long construction of the installation.

The invention has for its object to overcome this problem by providing an installation for the reliable and economical distillation of air that permits ensuring reduced construction delays.

To this end, the invention has for its object an installation for the distillation of air, comprising a medium pressure column, a low pressure column, a vaporizer-condenser for placing in heat exchange relation a calorigenic gas with the bottom liquid of the low pressure column and an element for confining cryogenic fluid, the low pressure column being beside the medium pressure column, characterized in that the base of the low pressure column is above the base of the medium pressure column and in that the low pressure column is disposed above this confinement element.

According to particular embodiments, the installation can comprise one or several of the following characteristics, alone or in any technically possible combination:

- the vaporizer-condensor is disposed above the medium pressure column
- the confinement element for cryogenic fluid comprises a mixing column;
- the installation comprises means for sending air to the base of the mixing column, means for sending a fluid rich in oxygen toward the head of the mixing column and a conduit for the production of impure gaseous oxygen withdrawn from the head of the mixing column; and
- the confinement element for cryogenic fluid comprises a storage reservoir of a cryogenic fluid, particularly liquid oxygen
- the confinement element for the fluid is an argon column supplied from the low pressure column, a column operating at a pressure intermediate the low pressure and the medium pressure, or heat exchanger
- the base of the low pressure column is located at the same level as the head of the medium pressure column or above this level.
- the low pressure column and the confinement element are integral.
- there is no distillation means above the medium pressure column.

The intermediate pressure column can be as described in EP-A-0538118 for example.

The heat exchanger may or may not be the vaporizer-condenser which permits heat exchange between the bottom liquid of the low pressure column and a calorigenic gas. For example, it may be a subcooler on the main heat exchanger in which feed air is cooled.

If the medium pressure column and the low pressure column are part of a conventional double column, the bottom liquid of the low pressure column is heated by the gas at the head of the medium pressure column and liquids enriched in oxygen and in nitrogen are sent from the medium pressure column to the low pressure column.

Preferably, the low pressure column and the confinement element for a cryogenic fluid are integral with each other.

The invention also has for its object a cold box adapted for the construction of an installation as described above, characterized in that it comprises the medium pressure column and the vaporizer-condenser or the low pressure column and the confinement element for cryogenic fluid, surrounded by a thermal insulation envelope.

According to another object of the invention, there is provided a process for erecting a separation apparatus comprising at least one medium pressure column, a low pressure column, if desired a confinement element for cryogenic fluid surmounted by the low pressure column, and a vaporizer-condenser to condense at least partially a calorigenic gas by heat exchange with a liquid from the low pressure column, in which the low pressure and medium pressure columns are mounted side by side, each column having its own cold box and once the medium pressure and low pressure columns are thus mounted, the vaporizer-condenser is mounted above the medium pressure column and the construction of the cold box of the medium pressure column is completed.

In particular, the vaporizer-condenser can permit condensing a gas from the medium pressure column by heat exchange with a liquid from the low pressure column.

The invention will be better understood from a reading of the description which follows, given solely by way of example, and with reference to the accompanying drawings, in which:

FIG. 1 shows an installation 1 for the distillation of air which essentially comprises:

Figure 1:
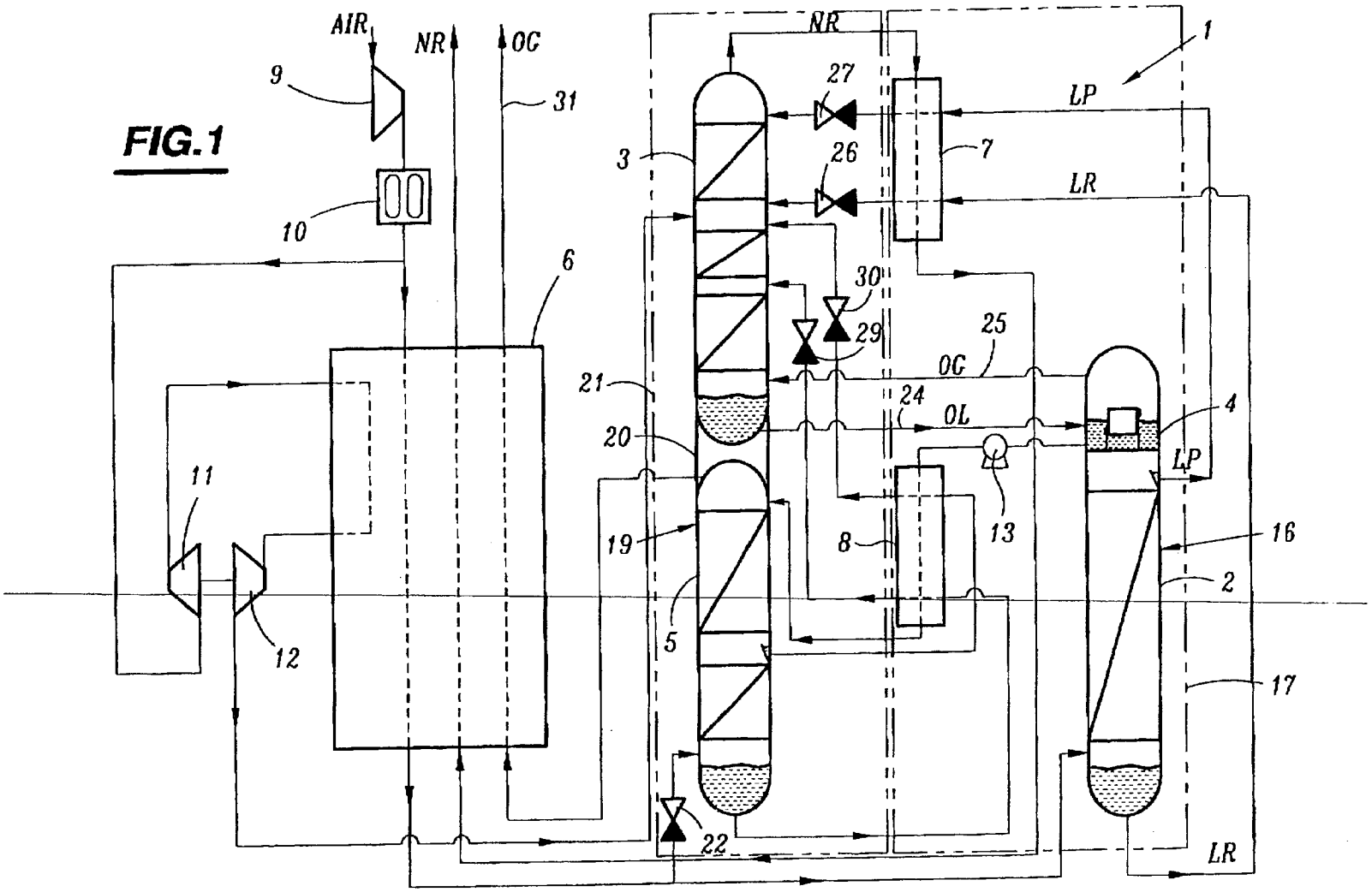
FIG. 1 is a schematic view of an installation according to the invention.

a double distillation column which comprises a medium pressure column 2, a low pressure column 3 and a vaporizer-condenser 4, for example of the bath type, a mixing column 5, a principal heat exchange line 6, two auxiliary heat exchangers 7 and 8, a principal air compressor 9, an apparatus 10 for the purification of air by adsorption, an auxiliary air compressor 11 coupled to an air expansion turbine 12, and a pump 13.

The vaporizer-condenser 4 is above the medium pressure column 2 to form a first erect structure 16 whose top is constituted by the vaporizer-condenser 4. This structure 16 is surrounded by a thermal insulation envelope 17 (in broken lines), which contains perlite (not shown) about the structure 16, comprising a cold box having the same reference numeral.

The low pressure column 3 is disposed above the mixing column 5 to form a second upright structure 19 or principal structure. A connecting skirt 20 connects the columns 3 and 5 and maintains the head of the column 5 spaced from the bottom of the column 3.

The second structure 19 is surrounded by a thermal insulation envelope 21 (in broken lines), which contains perlite (not shown) about the structure 19, thus forming a cold box having the same reference numeral.

In FIG. 1, the heat exchangers 7 and 8 have been positioned so as to facilitate illustration, such that the cold box 17 is of relatively greater dimensions, relative to the cold box 21, than in reality. In reality, these exchangers 7 and 8 are disposed so as to optimize the capacity of the cold box 17 which contains them.

The two structures 16 and 19 are disposed beside each other, the lower portion (at the bottom of FIG. 1) of the vaporizer-condenser 4 being disposed substantially at an intermediate level between the head of the medium pressure column 2 and the bottom of the low pressure column 3.

The operation of this installation 1, adapted to supply impure oxygen under medium pressure, is as follows.

The air to be distilled, previously compressed by the compressor 9 and purified by the apparatus 10, is then divided into two flows.

A first flow passes through the principal heat exchange line and is cooled to adjacent its dew point.

Then, this first flow is itself divided into two flows of which one is injected into the bottom of the medium pressure column 2 and of which the other is injected, after expansion in an expansion valve 22, into the bottom of the mixing column 5.

The second flow of compressed and purified air is compressed by the compressor 11, then cooled to an intermediate temperature by passing partially through the principal heat exchange line 6, and finally expanded through the turbine 12. This second flow is then introduced at a high intermediate level of the low pressure column 3.

The vaporizer-condenser 4 vaporizes liquid oxygen, of a purity of about 98%, from the bottom of the low pressure column 3, by condensation of nitrogen from the head of the medium pressure column 2. To this end, a conduit 24 sends liquid oxygen from the bottom of the low pressure column 3 to the vaporizer-condenser 4, and a conduit 25 returns the vaporized oxygen from the vaporizer-condenser 4 to the bottom of the column 3. The arrangement of a portion of the vaporizer-condenser 4 at a level below that of the bottom of the low pressure column 3 and above that of the head of the medium pressure column 2, permits the circulation, on the one hand, of liquid oxygen to the vaporizer-condenser 4 and, on the other hand, of condensed head nitrogen to the head of the medium pressure column 2, under the influence of gravity, without using a pump.

More generally, the arrangement of at least a portion of the vaporizer-condenser 4 at a level intermediate the head of the medium pressure column 2 and the bottom of the low pressure column 3 permits minimizing the pumping means necessary for the circulation of these liquids, no matter what the type of the vaporizer-condenser 4 that is used, namely with a bath, streaming liquid oxygen (so-called film vaporizer-condenser).

"Rich liquid" LR (air enriched in oxygen), from the bottom of the medium pressure column 2 is sub-cooled by passing through the auxiliary heat exchanger 7, then expanded in an expansion valve 26 and finally injected at the mentioned upper intermediate level of the low pressure column 3.

"Poor liquid" LP (somewhat pure nitrogen), from the head of the medium pressure column 2, is sub-cooled by passing through the auxiliary heat exchanger 7, then expanded in an expansion valve 27 and finally injected at the top of the low pressure column 3.

Impure or "residual" nitrogen NR, withdrawn from the top of the low pressure column 3, is reheated in the first instance by passing through the auxiliary heat exchanger 7, and then in the second instance through the principal heat exchange line 6.

The operation of the mixing column 5 will now be described.

A mixing column is a column which has the same structure as a distillation column but which is used to mix almost reversibly a relatively volatile gas, introduced at its base, and a less volatile liquid introduced at its top. Such a mixture produces cooling energy and therefore permits reducing the consumption of energy associated with distillation. Such a column is for example described in FR-A-2 143 986. In the present case, this mixture is used moreover to produce directly impure oxygen under a pressure slightly less than that prevailing in the medium pressure column 2.

Thus, liquid oxygen, from the base of the low pressure column 3, is withdrawn from the vaporizer-condenser 4, then pumped by the pump 13, and reheated by passage through the auxiliary heat exchanger 8. This liquid oxygen is then introduced into the head of the mixing column 5.

A second liquid rich in oxygen is withdrawn from the base of the mixing column 5 then sub-cooled by passing through the auxiliary heat exchanger 8. The second rich liquid is then expanded in an expansion valve 29 before being introduced at a lower intermediate level of the low pressure column 3.

Air enriched in oxygen, in liquid phase, is with15 drawn from an intermediate level of the mixing column 5 then re-cooled by passage through the auxiliary heat exchanger 8. This liquid is then expanded in an expansion valve 30 before being introduced at the mentioned upper intermediate level of the low pressure column 3.

Impure gaseous oxygen, of a purity of about 95%, is withdrawn from the head of the mixing column then reheated by passage through the principal heat exchange line 6 and distributed by a production conduit 31.

As a modification, the mixing column can be supplied at its head by several liquid streams of different composition.

The cold boxes 17 and 21 have been prefabricated in the factory and then transported, erected and operatively connected at the work site, then filled with perlite to form the installation 1. The prefabrication of the principal cold box 21 is not dependent on the production of the vaporizer-condenser 4 because this latter is not a part of the principal structure 19. Moreover, to construct the cold box 17, it suffices to arrange the vaporizer-condenser 4 above the medium pressure column 2.

Thus, a company making the columns 2, 3 and 5 can construct completely the cold box 21 and practically completely the cold box 17 while awaiting delivery of the vaporizer-condenser 4. The construction of the cold box 17 can be substantially carried out before this delivery, for example by assembling the medium pressure column 2, the side walls and the bottom of the thermal insulation envelope 17. It then only remains to mount the vaporizer-condenser 4 above the medium pressure column 2 and to complete the construction of the envelope 17.

These latter operations can if desired be carried out at the work site, the cold box 17 having been transported partially assembled.

The invention therefore permits achieving the objects recited at the beginning of the description by providing a reliable and economical installation that permits ensuring reduced delays of prefabrication and hence of construction. This latter advantage is due to the possibility of working in overlapping fashion, which is to say the possibility of carrying out a good deal of the construction of the cold boxes during construction of the vaporizer-condenser 4.

According to modifications, the second structure 19 could comprise, instead of or in addition to the mixing column 5, a storage reservoir for a cryogenic liquid, particularly liquid oxygen, a so-called Etienne column with an intermediate condenser (described for example in U.S. Pat. No. 2,699,046) or with a head condenser, a section of a column for the production of impure argon called a mixing column, or any other element for confining cryogenic fluid disposed below the low pressure column 3. Such a confinement element for cryogenic liquid permits ensuring a relative positioning of the low pressure column 3 and of the vaporizer-condenser 4 permitting the circulation of liquid oxygen from the bottom of the column 3 to the vaporizer-condenser 4 whilst minimizing the use of pumping means. Thus the bottom of the low pressure column 3 can be located at substantially the same level or above the vaporizer-condenser 4.

Figure 2:
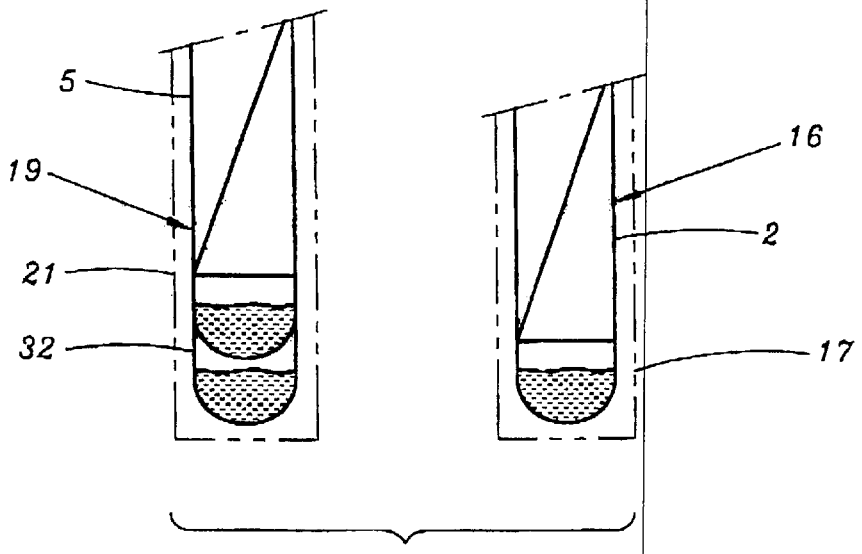
FIG. 2 is a fragmentary schematic view of the lower portions of the cold boxes of a modification of the installation of FIG. 1.

Thus, FIG. 2 shows a modification in which a reservoir 32 for the storage of a cryogenic liquid is disposed below the mixing column 5 to comprise the principal structure 19. The bottom of the reservoir 32 is at the same level as the bottom of the medium pressure column 2.

The reservoir 32 is, for example, buffer capacity for the storage of liquid oxygen from the bottom of the low pressure column 2.

In other embodiments not shown, the low pressure column 3 is disposed on a support sleeve to form the second erected structure 19. These embodiments are applicable for example to installations for the distillation of air which comprise only a double column for the distillation of air and no mixing column.

In the examples, the double columns comprise a low pressure column with a single vaporizer-condenser which serves to condense nitrogen from the medium pressure column by heat exchange with the bottom liquid of the low pressure column. Clearly the invention is also applicable to the case in which the nitrogen from the medium pressure column is condensed by heat exchange with an intermediate liquid from the low pressure column, the bottom liquid being vaporized by heat exchange with air, compressed nitrogen or a gas from the medium pressure column less volatile than nitrogen. In this case, two vaporizer-condensers can be used.

What is claimed is:

1. Installation (1) for the distillation of air, of the type comprising a double distillation column which itself comprises a medium pressure column (2), a low pressure column (3), means for withdrawing liquid from the medium pressure column and expanding said withdrawn liquid to produce an expanded fluid and for introducing said expanded fluid into the low pressure column, a vaporizer-condenser (4) to place in heat exchange relation a calorigenic gas with liquid from the bottom of the low pressure column, and an element (5) for confining cryogenic fluid that passes through the installation, the low pressure column being beside the medium pressure column, characterized in that the bottom of the low pressure column is higher than the bottom of the medium pressure column and in that the low pressure column (3) is disposed above this confinement element (5).

2. Installation according to claim 1, characterized in that the vaporizer-condenser (4) is disposed above the medium pressure column (2).

3. Installation according to claim 1 characterized in that the confinement element for cryogenic fluid comprises a mixing column (5).

4. Installation according to claim 3, characterized in that the installation (1) comprises means for sending a fluid rich in oxygen to the head of the mixing column, means for sending fluid less rich in oxygen toward the bottom of the mixing column and a conduit (31) for the production of impure gaseous oxygen withdrawn from the head of the mixing column.

5. Installation according to claim 1, characterized in that the element for confining the cryogenic fluid comprises a reservoir (32) for the storage of a cryogenic fluid, particularly liquid oxygen.

6. Installation according to claim 1, in which the confinement element for fluid is an argon column supplied from the low pressure column, a column operating at a pressure intermediate the low pressure and the medium pressure, or a heat exchanger.

7. Installation according to claim 1 in which the bottom of the low pressure column (3) is located at the same level as the head of the medium pressure column (2) or above this level.

8. Installation according to claim 1 in which the low pressure column and the confinement element are integral.

9. Installation according to claim 1 in which there is no distillation means above the medium pressure column (2).

10. Cold box (17, 21) adapted for the construction of an installation (1) according to claim 1, characterized in that it comprises the element for confining cryogenic fluid surmounted by the low pressure column (3, 5) or the medium pressure column surmounted by the vaporizer-condenser (2, 4) surrounded by a thermal insulation envelope (17, 21).

11. Process for mounting a separation apparatus containing at least one medium pressure column (2), a low pressure column (3), if desired an element (5) for confining a cryogenic fluid surmounted by the low pressure column, and a vaporizer-condenser (4) to condense at least partially a calorigenic gas by heat exchange with a liquid from the low pressure column comprising the steps of mounting the low pressure and medium pressure columns beside each other, each column having its own cold box, and thereafter mounting the vaporizer-condenser above the medium pressure column.

* * * * *